US006907826B1

(12) United States Patent
Berg et al.

(10) Patent No.: US 6,907,826 B1
(45) Date of Patent: Jun. 21, 2005

(54) METHOD AND DEVICE FOR PRINTING A BASE MATERIAL AND CLEANING A PRINTING ROLLER

(75) Inventors: Martin Berg, München (DE); Manfred Wiedemer, Ismaning (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 10/018,850

(22) PCT Filed: Jun. 28, 2000

(86) PCT No.: PCT/EP00/06026

§ 371 (c)(1),
(2), (4) Date: Apr. 15, 2002

(87) PCT Pub. No.: WO01/02170

PCT Pub. Date: Jan. 11, 2001

(30) Foreign Application Priority Data

Jun. 30, 1999 (DE) ..... 199 30 129

(51) Int. Cl.[7] ..... B41J 35/00
(52) U.S. Cl. ..... 101/424; 101/425
(58) Field of Search ..... 101/423–425, 101/483, 167, 170, 192

(56) References Cited

U.S. PATENT DOCUMENTS 3,807,853 A * 4/1974 Hudson ..... 399/357
4,716,829 A * 1/1988 Wenzel ..... 101/483
4,729,310 A * 3/1988 Love, III ..... 101/157
5,181,470 A * 1/1993 Barrois et al. ..... 101/425
5,237,375 A * 8/1993 Michlin et al. ..... 399/274
5,370,052 A * 12/1994 Reslow ..... 101/483
5,749,293 A * 5/1998 Ota et al. ..... 101/157
5,911,175 A * 6/1999 Sondergeld et al. ..... 101/424
5,948,740 A * 9/1999 Christianson ..... 510/171
6,070,528 A * 6/2000 Fleischmann et al. ..... 101/170
6,354,213 B1 * 3/2002 Jenkins ..... 101/483
6,631,676 B2 * 10/2003 Weichmann et al. ..... 101/170

FOREIGN PATENT DOCUMENTS

| | | |
|---|---|---|
| DE | 16 11 272 | 5/1975 |
| DE | 295 07 416 U1 | 8/1995 |
| DE | 195 03 951 A1 | 8/1996 |
| DE | 195 44 099 A1 | 5/1997 |
| EP | 0 836 939 A1 | 4/1998 |
| WO | WO 95/29063 | 11/1995 |
| WO | WO 97/24233 | 7/1997 |

OTHER PUBLICATIONS

IBM Technical Disclosure Bulletin, vol. 20, No. 1, Jun. 1977, pp. 440-442.

* cited by examiner

*Primary Examiner*—Anthony Nguyen
(74) *Attorney, Agent, or Firm*—Schiff Hardin LLP

(57) ABSTRACT

A printer has a printing drum with recesses on the surface thereof into which ink is provided for printing. After printing, any remaining ink is removed at a cleaning station including immersion in a fluid, air jets, or an air suction. The cleaning station and the inking station operate simultaneously.

19 Claims, 5 Drawing Sheets

METHOD AND DEVICE FOR PRINTING A BASE MATERIAL AND CLEANING A PRINTING ROLLER

BACKGROUND OF THE INVENTION

1. Field of the Invention

The present invention is directed to a method for printing a carrier material, whereby a printing drum with a plurality of depressions arranged on the surface of the printing drum for the acceptance of printing fluid turns around its longitudinal axis during a printing event. With the assistance of an inking station, printing fluid is introduced during the printing event into all depressions that move past the inking station. At a transfer printing location, the printing fluid contained in some of the depressions moving past the transfer printing location is employed for printing the carrier material. The printing fluid in the other depressions moving past the transfer printing location remains in the depressions.

2. Description of the Related Art

European Letters Patent EP 0 756 544 B1 discloses a thermoelectric printing unit for the transfer of an ink onto a recording medium. An inking station, a transfer printing station and a cleaning station are arranged around a printing drum having a plurality of depressions for the acceptance of ink. Only the inking station and the transfer printing station are in operation during the printing event. The depressions proceed to the inking station after they have passed by the transfer printing station. Printing fluid is re-introduced into the emptied depressions at the inking station. The cleaning station is actuated only after the end of the printing event. German Patent Document DE 295 07 416 U1, discloses a rotogravure unit wherein a rotogravure printing cylinder has ink-accepting depressions at image locations and no such depressions at non-imaging locations. The depressions are filled with ink at an inking station. This ink is transferred onto a rubber cylinder for later transfer onto paper. Subsequently, the ink residues are washed from the depressions of the image locations on the rotogravure printing cylinder with the assistance of a water jet and are thus removed.

German Patent Document DE 195 44 099 A1 discloses a thermographic printer device wherein a glass cylinder has a cup structure on its generated surface, the cups thereof being filled with ink. The ink in the cups is solidified with the assistance of a cooling device. In a printing zone, the ink in selected cups is melted with the assistance of laser light dependent on the image structure to be printed and is transferred onto paper. A doctor blade strips the residues of the ink from the surface of the inking cylinder, the cups thereof being subsequently re-filled with ink.

German Patent Document DE 195 03 951 A1 discloses a rotogravure method, whereby a rotogravure printing cylinder is filled with ink in depressions at imaging locations, said ink being directly printed onto a carrier material. After the printing event, the specific depressions are cleaned of ink residues and re-filled with ink for a further printing event.

German Patent Document DE 16 11 272 C2, further, discloses an offset rotary printing press that has a printing cylinder on whose generated surface a planographic form is chucked. This planographic form accepts ink in depressions that correspond to image locations to be inked, the ink being supplied via an ink application roller. The ink that is not picked up by the printing cylinder is removed from the ink application roller and is supplied to the ink circulation.

SUMMARY OF THE INVENTION

An object of the invention is to provide a method for printing a carrier material that is simple and enables a printing with high printing quality. Moreover, a printer device suitable for the implementation of the method should be recited.

The object relating to the method is achieved with the method steps for printing a carrier material, whereby a printing drum having a plurality of depressions for the acceptance of printing fluid arranged on the surface of the printing drum rotates around its longitudinal axis during a printing event, printing fluid is introduced by an inking station into depressions moving past the inking station, printing fluid from some of the depressions moving past a transfer printing location is employed at the transfer printing station for printing the carrier material, and printing fluid remains in the rest of the depressions, printing fluid is removed by a cleaning station from depressions moving past the cleaning station, and whereby the cleaning station and the inking station are simultaneously in operation during the printing event.

In the preferred method, the cleaning station contains a cleaning drum that lies parallel to the printing drum and whose surface touches the surface of the printing drum in a cleaning region during cleaning; and the surface of the cleaning drum is manufactured of an elastic or absorbent material. The cleaning drum may carry a potential that differs from a potential on the surface of the printing drum. Specifically, the cleaning station contains a stripper drum that lies parallel to the cleaning drum and whose surface exerts pressure onto the surface of the cleaning drum in a stripping region; and the surface of the stripper drum is fabricated of a hard material. In one embodiment, the emptied depressions are cleaned with a cleaning fluid after the removal of the printing fluid from depressions moving past the cleaning station and before the introduction of printing fluid into depressions moving past the inking station. The cleaning station can contain a cleaning container with a cleaning fluid that is preferably arranged under the printing drum; and depressions moving past the cleaning container are immerse into the cleaning fluid. As a further development of the invention, the printing fluid is employed as the cleaning fluid. The cleaning fluid may be moved by additional measures, preferably by introduction of ultrasound.

In other embodiments of the invention, the cleaning station contains a blower unit that, with the assistance of air, displaces printing fluid out of the depressions moving past the cleaning station. In the present method, the cleaning station contains a suction unit with whose assistance air is sucked in, the air entraining printing fluid from the depressions moving past the cleaning station. The printing fluid removed with the assistance of the cleaning station is collected; and the collected printing fluid is conducted to the inking station.

Further advantages of the invention are realized in an embodiment wherein the printing fluid is cleaned and/or rejuvenated.

A printer device for printing a carrier material is also provided wherein a printing drum rotating around its longitudinal axis during the printing event and on whose surface a plurality of depressions for the acceptance of printing fluid are arranged, an inking station for introducing printing fluid into depressions that move past the inking station, a transfer printing station at which printing fluid from some of the depressions moving past the transfer printing location is employed for printing the carrier material, and at which the printing fluid remains in the rest of the depressions moving past the transfer printing station, a cleaning station for removing printing fluid from depressions that move past the cleaning station, and a control unit for the actuation of the cleaning station and of the inking station, the control unit simultaneously places the cleaning station and the inking station into operation during the printing event.

In the printer device, a cleansing station for cleansing the depressions emptied in the cleaning station with a cleaning fluid may be provided. The cleaning station may contain a cleaning drum that lies parallel to the printing drum and whose surface touches the surface of the printing drum in a cleaning region; and the surface of the cleaning drum preferably carries a different potential than the surface of the printing drum. Preferably, the cleaning station contains a stripper drum that lies parallel to the cleaning drum and whose surface presses onto the surface of the cleaning drum in a stripping region. The cleaning device may contain a blower unit with whose assistance air is blown into the depressions moving past the cleaning station; and/or the cleaning station contains a suction unit with whose assistance air is sucked out of the depressions moving past the cleaning station.

The invention proceeds on the basis of the perception that a printing having high printing quality can only be achieved when all depressions are completely emptied before the depressions are transported past the inking station and are filled anew with printing fluid by the inking station. This is particularly significant in printing methods wherein the volume of a respective depression prescribes the volume of printing fluid to be applied onto a picture element. Even given depressions whose printing fluid is used during printing, it is not assured that all of the printing fluid can be applied onto the carrier material. This is especially true when, due to adhesive forces between the printing fluid and the carrier material, the printing fluid is drawn toward the carrier material. In this case, forcing the printing fluid out of the depression is foregone, this, for example, being implemented with the assistance of a gas bubble.

The inventive method therefore employs a cleaning station that removes the printing fluid from the depressions moving past the cleaning station. The cleaning station and the inking station operate simultaneously during the printing event. In the inventive method, thus, the printing fluid is removed from all of the depressions before the depressions are employed in a new printing event. Due to the removal of the printing fluid at the cleaning station, the printing fluid is also prevented from drying on the sidewalls of the depressions during the printing event. The volume capacity of the depressions remains unchanged during the entire printing event. The printing fluid is also prevented from remaining in a depression over a plurality of revolutions of the printing drum and physically or chemically changing during this time, for example in terms of viscosity or composition when highly volatile tensides are contained in the printing fluid.

What the utilization of the inventive method achieves is that a prescribed quantity of printing fluid having a prescribed composition and prescribed physical parameters can be employed for each picture element even given a continuous printing mode. The result is a print image having a high quality.

In a development of the inventive method, the cleaning station contains a cleaning drum that lies parallel to the printing drum and whose surface touches the surface of the printing drum in a cleaning region during cleaning. The surface of the cleaning drum is manufactured of an elastic or of an absorbent material that can be pressed into the depressions. The employment of a cleaning drum is a simple possibility for removing the printing fluid that remains in the depressions. Given an elastic surface of the cleaning drum, this can be pressed against the printing drum in an enlarged cleaning region. The printing fluid remaining in the depressions thus has comparatively more time to attach to the surface of the cleaning drum. Cleaning drums at whose surface bristles are arranged are also employed. The cleaning device must be pressed tightly against the printing drum in order to avoid contamination of the printing unit due to printing fluid that spatters during brushing.

In another development, the cleaning drum carries an electrical potential that differs from the potential of the surface of the printing drum. This measure facilitates the release of the printing fluid from the depressions because the electrostatic forces attract the printing fluid out of the depression, it acts in addition to the adhesion forces between printing fluid and surface of the cleaning drum. Potentials having different operational signs are also employed.

In a next development, the cleaning station, in addition to containing the cleaning drum, contains a stripper drum lying parallel to the cleaning drum whose surface exerts pressure onto the surface of the cleaning drum in a stripping region. The surface of the stripper drum is made of a hard material, for example of metal. Whereas absorbent material can be damaged when being squeezed by a doctor blade, stripping the printing fluid from the stripper drum can be carried out without damage. The stripper drum has a smooth surface on which the doctor blade lies well.

In one development of the inventive method, the emptied depressions are cleaned with a cleaning fluid after the emptying of the printing fluid from the depressions by moving the depressions past the cleaning station before the introduction of the printing fluid into the depressions moving past the inking station. The cleaning step leads to a more thorough emptying and cleaning of the depression and assures that the printing fluid is always filled into the depressions in the inking station under constant conditions. During cleaning, dirt particles are also removed from the edges of the depressions, the dirt particles being produced, for example, due to abrasion of the carrier material or by abrasion at the edges of the depressions.

In a next development, the cleaning fluid is contained in a cleaning container arranged under the printing drum. The depressions move past the cleaning container immersed into the cleaning fluid. The immersion assures that the cleaning fluid is forced into the depressions with a specific pressure. Moreover, the cleaning fluid is agitated due to the immersion. The increased pressure and the movement of the cleaning fluid lead to a better removal of the dirt particles seated at the sidewalls of the depressions. In a next development, the printing fluid is employed as a cleaning fluid, so that additional cleaning fluids can be foregone. When, however, a very thorough cleaning is important, then solvents are employed as the cleaning fluid.

In a next development, the cleaning fluid is moved by additional measures that proceed beyond the movement of the cleaning fluid due to the immersion of the printing drum. The employment of ultrasound assures that dirt particles that adhere very firmly to the sidewalls can also be released. Moreover, larger dirt particles are comminuted by the ultrasound.

In one development of the inventive method, the cleaning station contains a blower with whose assistance air is blown into the depressions moving past the cleaning station. When the air is blown into the depressions, the printing fluid is blown out at the same time. Blowing the air in is implemented instead of or in combination with the cleaning by the cleaning drum.

In a next development, a suction pump is employed in the cleaning station, to suction air out of the depressions moving past the cleaning station. Any printing fluid remaining in the depressions is also removed simultaneously with the air. No spattering of printing fluid occurs in the suctioning process, so that measures to prevent spattering printing fluid need not be undertaken.

When, in a next development, the printing fluid that has been removed in the cleaning station is collected and conducted to the inking station, then a circulation derives for the printing fluid that assures that the printing fluid can be completely printed.

In a next development, the printing fluid is cleaned and/or rejuvenated as it is carried in the printing fluid circulation. Filtering makes it possible to remove foreign bodies and ink particles that have already dried from the printing fluid. A rejuvenation of the printing fluid may involve in, for example, introducing additives such as water or solvent into the printing fluid.

The invention also applies to a printer device that is employed for the implementation of the inventive method. The technical effects indicated above thus also apply to the inventive printer device and developments thereof.

BRIEF DESCRIPTION OF THE DRAWINGS

Exemplary embodiments of the invention are explained below on the basis of the attached drawings.

DETAILED DESCRIPTION OF THE PREFERRED EMBODIMENTS

Figure 1:
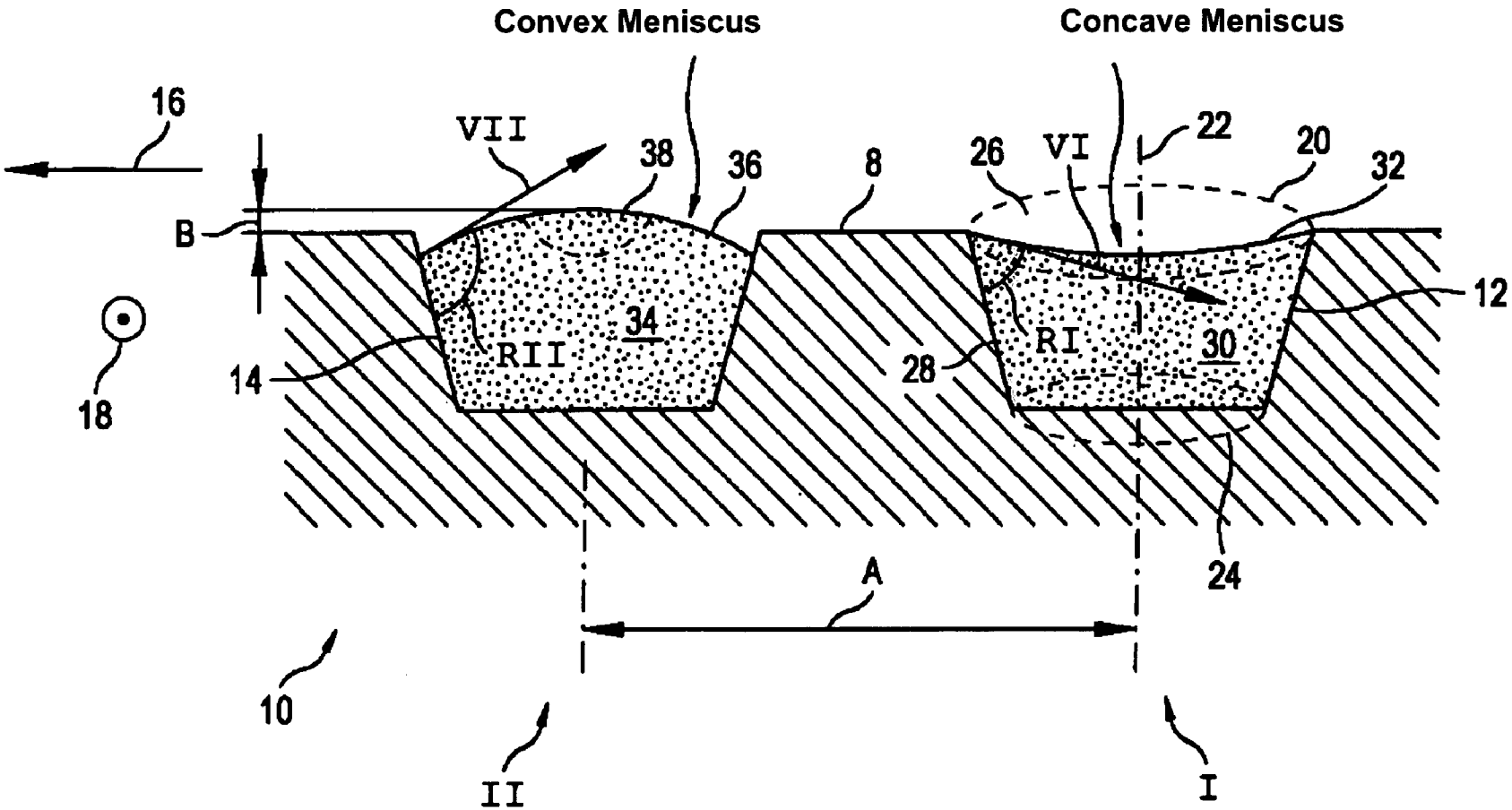
FIG. 1 is an enlarged cross section of a portion of a printing drum.

FIG. 1 shows a longitudinal section along the surface 8 of a printing drum 10. A plurality of depressions arranged matrix-like are located in the surface 8 of the printing drum 10, two depressions 12 and 14 thereof being shown in FIG. 1. The depressions are arranged next to one another in a row direction, see arrow 16. Neighboring depressions 12 and 14 have a spacing A from one another that determines the resolution of the printer. A plurality of rows of depressions are arranged following one another in column direction 18, whereby neighboring depressions with a column also have a spacing from one another that corresponds to the spacing A. The depressions are all identically constructed, so that the structure of only the depression 12 is explained below.

The depression 12 is fashioned as a conoidal frustum-shaped recess (see contour 20) and thus has circular cross-sections. The axis of the conoidal frustum lies in the direction of the normal of the surface 8. The conoidal frustum-shaped contour 20 tapers with increasing distance from the surface 8 of the printing drum 10. A bottom surface 24 of the depression 12 has a smaller diameter than the opening 26 of the depression 12 lying on the surface of the printing drum 10. The circumference of the opening 26 lies on a circle and prescribes the shape of the picture elements to be printed.

An all-around sidewall 28 of the depression 12 is arranged obliquely relative to the surface 8 of the printing drum 10. The filling of a chromatic ink 30 is facilitated by the conoidal frustum-shaped fashioning of the depression 12. The ink 30 is held within the depression 12 by capillary forces. The capillary forces are greater than the force of gravity the earth exerts on the ink 30, so that the ink also remains within the depression 12 when the opening 26 is directed down, i.e. toward the center of the earth. After the filling of the ink 30 and the squeegeeing of the printing drum 10 with a doctor blade, the surface 32 of the ink 30 has a surface tension at which a convex curvature occurs, i.e. the surface 32 of the ink 30 is arced inward. The surface 32 is in a condition I wherein a wetting angle RI has a value of approximately 45°. The wetting angle RI is described by a vector VI of the surface tension on the surface 30 and by the side wall 28. The vector VI begins at the edge of the depression 12, i.e. at a location at which the fluid 30 adjoins the sidewall 28 or, respectively, surface 8. The volume capacity of the depression 12 is selected such that exactly that quantity of ink 30 that is required for printing a single picture element is accepted.

How a condition II of the surface 36 of the ink 34 affects the printing event shall be explained below on the basis of a printing fluid 34 within the depression 14. After being filled into the depression 14, the ink 34 also has an inwardly arced, i.e. concave, surface. The surface tension of the ink 34 was increased due to the evaporation of tensides with the assistance of an exposure device (shown at the bottom in FIG. 2), as a result whereof the surface 36 has arced outward. A wetting angle RII between a surface tension vector VII and the sidewall of the depression 14 has a value of somewhat above 90°. The vector VII begins at the sidewall of the depression 14 and proceeds in the direction of the surface tension of the surface 36. The starting point of the surface tension vector VII lies at the boundary between printing fluid 34 and the sidewall of the depression 14. A middle region 38 of the surface 36 projects beyond the surface 8 of the printing drum 10 by a distance B. When the depression 14 is conducted past paper to be printed upon at a distance that is less than the distance B, then a wetting of the paper occurs. The adhesion forces between the paper and the printing fluid 34 are higher than the capillary forces between printing fluid 34 and depression 14. All of the printing fluid 34 is therefore drawn out of the depression 14 and inks a region on the paper that is provided for a picture element.

Figure 2:
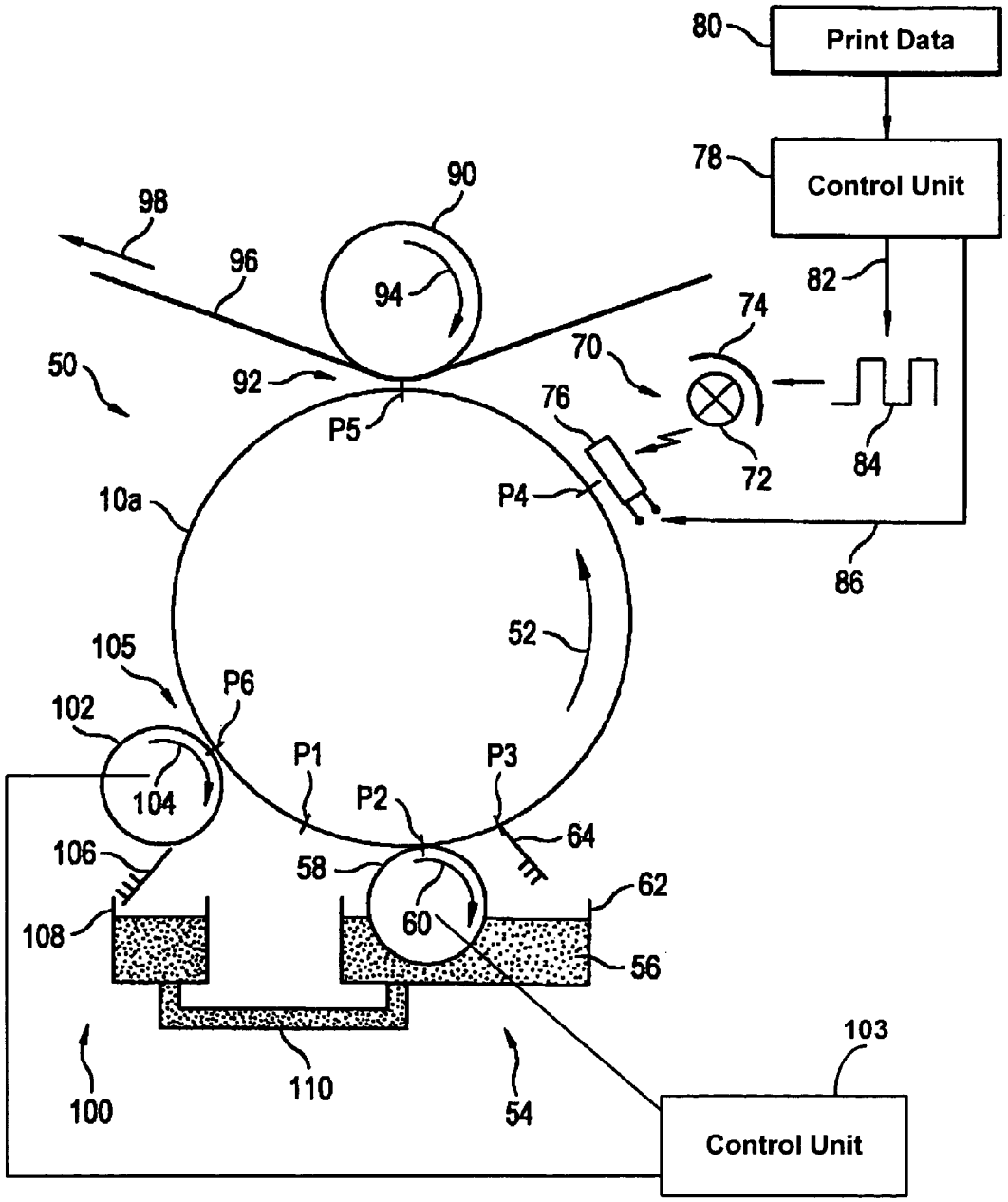
FIG. 2 is a schematic diagram of a printing unit of a printer.

FIG. 2 shows a printing unit 50 of a printer that has a resolution of 600 dpi (dots per inch). A printing drum 10*a* turns in counter-clockwise direction, see arrow 52. The devices enumerated below are successively arranged along the circumferential direction of the printing drum 10*a*.

At the beginning of a revolution of the printing drum 10*a*, the depressions for printing a row that extend in a longitudinal direction of the printing drum 10*a* are free of the printing fluid, see position P1. Ink 56 is filled into the depressions of a row at an inking station 54. The inking station 54 contains a scoop drum 58 whose axis proceeds parallel to the axis of the printing drum 10*a*. At the position P2, the surface of the scoop drum 58 touches the surface of the printing drum 10*a*. The scoop drum 58 turns in a direction opposite that of the printing drum 10*a*, see arrow 60. The lower part of the scoop drum 58 immerses into the ink 56 held by a reservoir 62, so that the surface of the scoop drum 58 is moistened with ink when the surface reaches the position P2. Due to the capillary forces, the ink 56 is drawn from the surface of the scoop drum 58 into the depressions 12, 14 of the printing drum 10*a*, which is located at position P2.

A doctor blade 64 is situated at a position P3, the doctor blade 64 sweeping over the surface of the printing drum 10*a* such that no ink remains on the surface of the printing drum 10*a* outside the depressions. After being swept with the doctor blade 64, the ink in all depressions respectively has an inwardly arced surface.

The depressions of a row filled with ink 56 are subsequently transported by rotation of the printing drum 10*a* to a position P4 at which an exposure device 70 modifies the surface tension in selected depressions. The exposure device 70 contains a tubular flashbulb 72 whose longitudinal axis is arranged parallel to the longitudinal axis of the printing drum 10*a*. A reflector 74 that extends along the flashbulb 72 and has an arcuate crossection is located at that side of the flashbulb 72 facing away from the printing drum 10*a*. The flashbulb 72 is located roughly in the focus of the reflector 74. The exposure device 70 also contains a line composed of ceramic cells 76 arranged next to one another whose transparency can be varied with the assistance of a control voltage. When exposing a row of depressions at the position P4, exactly one ceramic cell 76 is located opposite each depression. The ceramic cells 76 are transparent, ferroelectric ceramic laminae. Such ceramic laminae are known in the field of optoelectronics. For example, such ceramic laminae are disclosed as PLZT elements in European Letters Patent EP 0 253 300 B1. However, optoelectronic elements that work according to the Kerr principle are also employed. The exposure device 70 is controlled by a drive device 78 dependent on print data 80 that define the picture elements of the print image to be printed. A clock signal 84 that clocks the flashbulb 72 synchronously with the revolution of the printing drum 10*a* is generated at a first output line 82 of the drive device 78, so that each row of depressions that is moved past the position P4 is irradiated exactly once by the flashbulb 72.

Output lines 86 lead from the drive device 78 to the individual ceramic cells 76 of the line of ceramic cells 76. The drive unit 78 drives the ceramic cells 76 such that a ceramic cell 76 under consideration is light-transmissive when the depression lying opposite the appertaining ceramic cell 76 contains ink that is to be used for printing given the next transport past at a position P5. The light coming from the flashbulb 72 can then proceed through the appertaining ceramic cell 76 onto the ink. The light energy evaporates tensides that are situated at the surface of the ink. The result is that the surface tension of the inks rises and the wetting angle becomes larger. When, in contrast, the ink situated in a specific depression is not to be employed for printing a picture element, then the ceramic cell 76 lying there opposite is darkened with the assistance of the control device 78, so that no light from the flashbulb 72 can be incident onto the depression. The surface tension and the wetting angle of the ink remain unaltered.

As explained above on the basis of FIG. 1, there are depressions wherein the surface of the printing fluid has the condition I after a row of depressions has been transported past the position P4. The surface of the ink has the condition II in other depressions.

A transfer printing zone 92 is located at the position P5 between the printing drum 10*a* and a transport roller 90. The longitudinal axis of the transport roller 90 lies parallel to the axis of the printing drum 10*a*. A transport device (not shown) turns the transport roller 90 in a direction opposite that of the printing drum 10*a*, see arrow 94. Continuous form paper 96 is transported in a transport direction 98 between printing drum 10*a* and transport roller 90. The continuous form paper 96 lies against the surface of the transport roller 90.

Continuous form paper 96 and the surface of the printing drum 10*a* have the same speed in the region of the transfer printing zone 92, so that they are at rest relative to one another. That surface of the continuous form paper 96 facing toward the printing drum 10*a* has a spacing from the surface of the printing drum 10*a* that is smaller than the spacing B, see FIG. 1. In the region of the transfer printing zone, the continuous form paper 92 is printed at locations that lie opposite depressions whose ink has a high surface tension and, thus, a great curvature at the surface, condition II.

After the depressions have been transported past the position P5, there are depressions in which ink 56 is still present. The ink 56 was removed from other depressions when printing in the transfer printing zone 72. A cleaning station 100 is located at a position P6. The cleaning station 100 contains a cleaning drum 102 whose longitudinal axis lies parallel to the longitudinal axis of the printing drum 10*a*. The cleaning drum 102 turns in a direction opposite that of the printing drum 10*a*, see arrow 104. As noted above in the summary, a control unit for actuation of the cleaning station and the inking station is provided to simultaneously place the cleaning station and the inking station into operation during the printing event. The control unit, marked 103, in the drawing is connected to both the cleaning station and the inking station to provide the described simultaneous operation. At the position P6, the surface of the cleaning drum 102 and the surface of the printing drum 10*a* touch in a cleaning region 105. The surface of the cleaning drum 102 is fabricated of an absorbent material that draws ink out of the depressions in which ink has remained. Ink that was previously in the depressions on the printing drum 10*a* is squeegeed off from the cleaning drum 102 with the assistance of a doctor blade 106. The removed ink runs into a collecting basin 108 arranged under the doctor blade 106. After being transported past the position P6, the depressions on the printing drum 10*a* have returned into their original condition as explained above for the position P1.

A compensating line 110 via which the ink dripping down from the doctor blade 106 returns into the reservoir 62 is situated between the collecting basin 108 of the cleaning station 100 and the reservoir 62 of the inking station 54. An ink circulation is thus closed via the compensating line 110.

Figure 3:
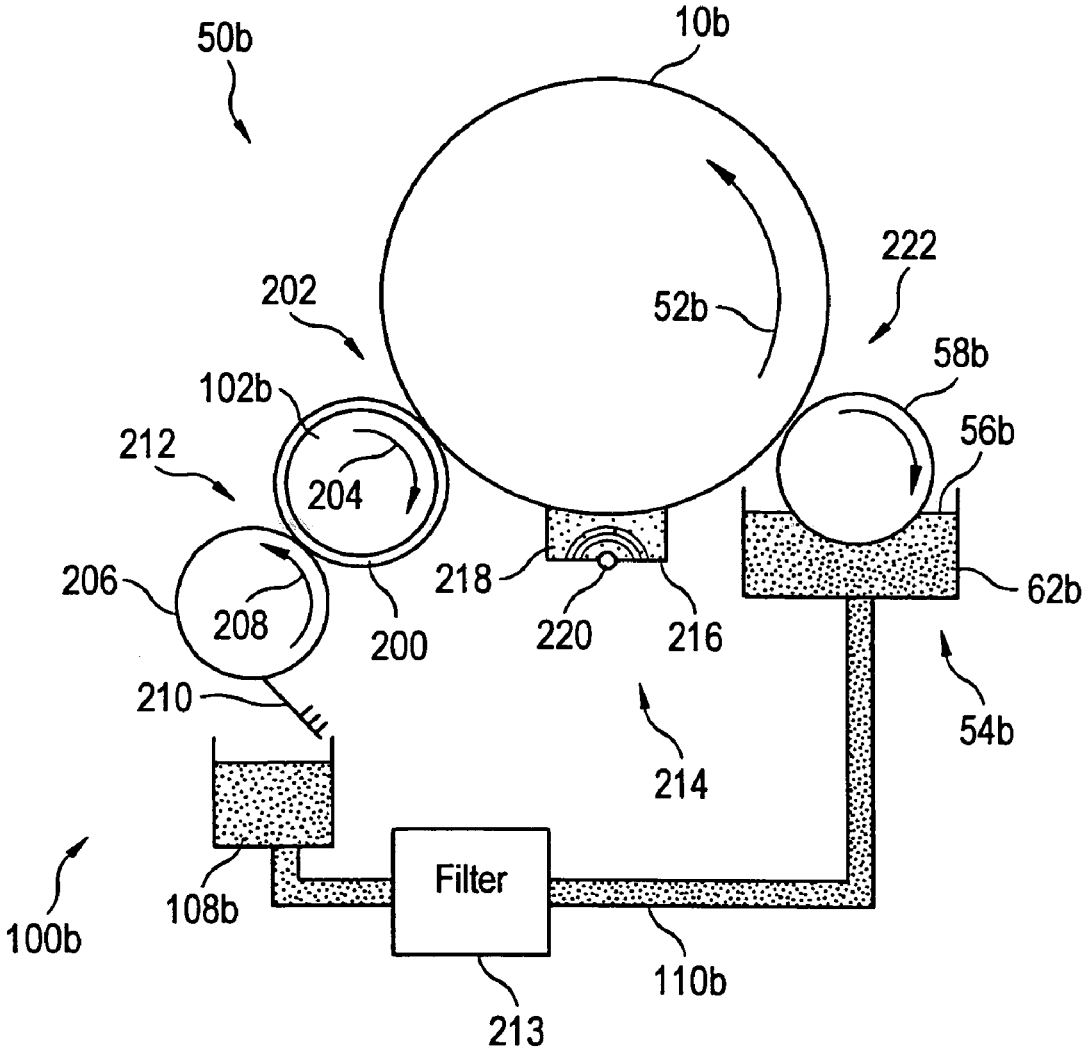
FIG. 3 is a schematic diagram of a cleaning station with a cleaning drum and an ultrasound bath.

FIG. 3 shows a cleaning device 100*b* that is employed in a printing unit 50*b*. An exposure device employed in the printing unit 50*b* and a transfer printing station past which the carrier material is conducted are not shown in FIG. 3 since their structure is identical to the structure of the exposure device 70 or, respectively, to the structure of the transfer printing station 90 through 98. A printing drum 10*b* of the printing unit 50*b* has the same structure as the printing drum 10*a* and turns counter-clockwise in the direction of an arrow 52*b*. The cleaning station 100*b* is located at the printing drum 10*b* at approximately the same position as the cleaning station relative to the printing drum 10*a*, i.e. obliquely under the shaft of the printing drum 10*b*. A cleaning drum 102*b* contained in the cleaning station 100*b* is arranged parallel to the printing drum 10*b*. The surface of the cleaning drum 102*b* is formed by an elastic coating 200. The surface of the coating 200 touches the printing drum 10*b* along a cleaning region 202. The cleaning drum 102*b* turns in the same sense as the printing drum 10*b*, see arrow 204.

A stripper drum 206 lies parallel to the cleaning drum 102*b* at that side of the cleaning drum 102*b* facing away from the cleaning region 202. The stripper drum 206 turns in a direction opposite that of the cleaning drum 102*b*, see arrow 208. A doctor blade 210, whose downwardly directed lower edge is arranged above a collecting basin 108*b*, is located under the stripper drum 206.

The cleaning drum 102*b* removes ink from the depressions that remained in the depressions of the printing drum 10*b*. Due to the rotational movement of the cleaning drum 102*b*, the removed ink is transported to the stripper drum 206 and proceeds onto the stripper drum 206 at a stripping region 212. The ink that is stripped off is then transported to the doctor blade 210 by the stripper drum 206 along the circumferential direction of the stripper drum 206. The doctor blade 210 squeegees the ink from the stripper drum 206. The ink drips from the doctor blade 210 into the collecting basin 108. The collecting basin 108*b* is connected via a compensating line 110*b* to a reservoir 62*b* of an inking station 54*b*. The compensating line 110*b* runs through a filter unit 213 than contains a fine-pore filter in which paper fibers and dried ink collect. In another exemplary embodiment, a catalyst substance that decomposes foreign bodies in the ink is employed in the filter unit.

An ultrasound bath 214 is arranged under the shaft of the printing drum 10*b* between the cleaning station 100*b* and the inking station 54*b*. The ultrasound bath 214 contains a container 216 whose upper edges lie against the printing drum 10*b*. The container 216 is completely filled with a solvent-containing cleaning fluid 218. An ultrasound transmitter 220 in the floor region of the container 216 sends ultrasound waves through the cleaning fluid 218 to the surface of the printing drum 10*b*. When depressions of the printing drum 10*b* move past the ultrasound bath 214, then the depressions immerse into the cleaning fluid 218 and are filled with cleaning fluid 218. The cleaning fluid 218 forms a transmission medium for the ultrasound, so that the ultrasound proceeds up to the sidewalls of the depressions and strips foreign bodies adhering thereto off. When the depressions leave the ultrasound bath 214, then the cleaning fluid runs out due to gravity and remains in the container 216.

The depressions that are emptied at the cleaning station 100*b* and cleaned in the ultrasound bath 214 are transported to the inking station 54*b* due to the rotational motion of the printing drum 10*b*. The inking station 54*b* contains a scoop drum 58*b* that is arranged parallel to the printing drum 10*b* and turns in a direction opposite the rotational sense of the printing drum 10*b*, see arrow 60*b*. The scoop drum 58*b* dips into the ink 56*b* that is present in the reservoir 62*b*. Due to the rotational motion of the scoop drum 58*b*, ink is transported from the reservoir 62*b* to the printing drum 10*b*. The depressions moving past at the inking station 62*b* are filled with ink 56*b* in an inking region 222. A doctor blade (not shown) subsequently serves the purpose of squeegeeing ink not situated inside depressions from the printing drum 10*b*. Moreover, the employment of the doctor blade also causes the printing fluid in the depressions to arc inward.

Figure 4:
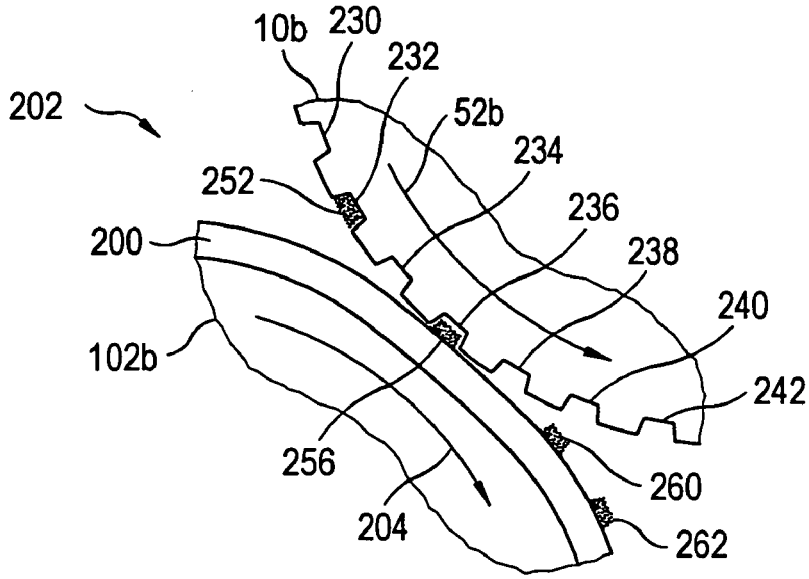
FIG. 4 is a magnified illustration of a cleaning region.

FIG. 4 shows a magnified illustration of the cleaning region 202. Depressions 230 through 242 in the surface of the printing drum 10*b* are shown disproportionately large in FIG. 4. After being transported past the transfer printing location 92 (see FIG. 2), printing fluid 252, 256, 260 or, respectively, 262 was present in the depressions 232, 236, 240 or, respectively, 242. The coating 200 is composed of an elastic material and presses into the depressions in the cleaning region, see depression 236. Due to the force of adhesion between the printing fluid 256 and the coating 200, the printing fluid 256 is pulled out of the depression 236. The printing fluid 260 or, respectively, 262 that was present in the depression 240 or, respectively, 242 was already transferred onto the coating 200 at the cleaning region 202.

Figure 5:
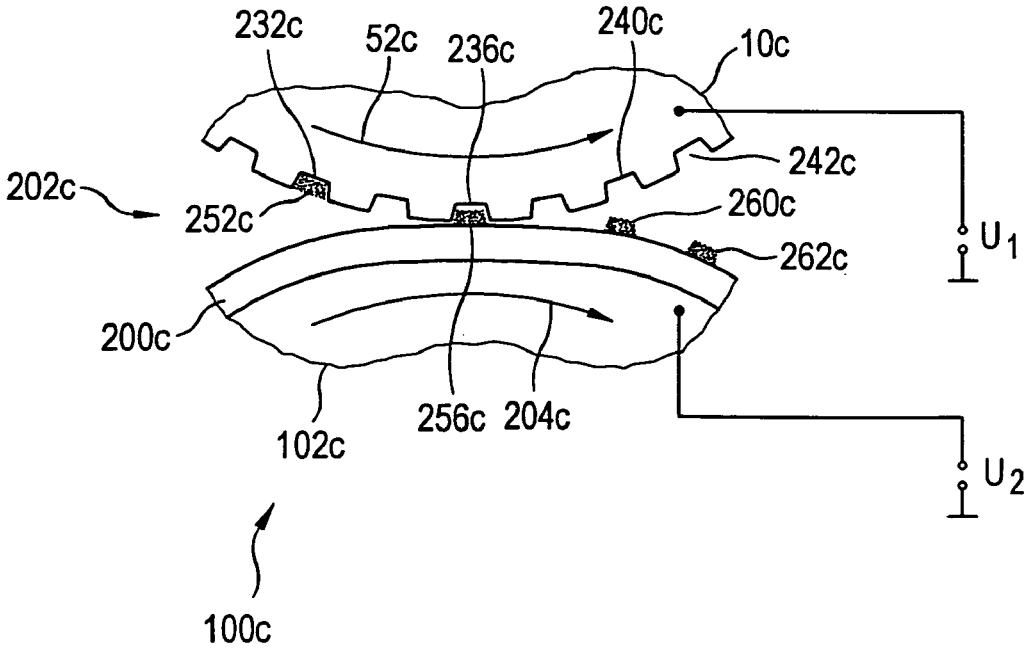
FIG. 5 is a cleaning station with a potential-carrying cleaning drum.

FIG. 5 shows a portion of a cleaning station 100*c* that is constructed essentially like the cleaning station 100*b*. Instead of the cleaning drum 102*b*, a cleaning drum 102*c* that likewise has an elastic coating 200*c* at its surface is employed in the cleaning station 100*c*. The cleaning drum 102*c* and a printing drum 10*c*, both of which are fabricated of a metallic material, lie opposite one another at a cleaning region 202*c*. A potential is generated on the printing drum 10*c* with the assistance of a voltage U1. A voltage U2 generates a potential on the surface of the cleaning drum 102*c* that is lower than the potential on the surface of the printing drum 10*c*. The difference in potential leads thereto that printing fluid 252*c*, 256*c*, 260*c* or, respectively, 262*c* easily releases from depressions 232*c*, 2326*c*, 240*c* or, respectively, 242*c* when the printing drum 10*c* and the cleaning drum 102*c* rotate in opposite directions relative to one another, see arrows 52*c* and 204*c*. In another exemplary embodiment, one of the voltages U1 or, respectively, U2 is reversed in polarity, so that the potential on the printing drum 10*c* has a different operational sign from the potential on the cleaning drum 102*c*.

Figure 6:
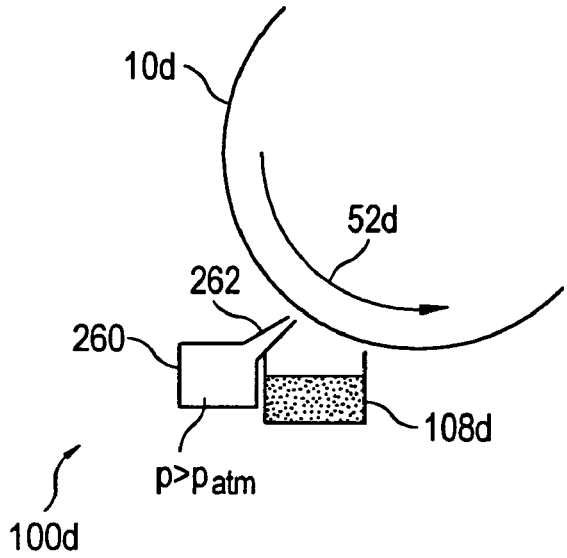
FIG. 6 is a cleaning station with a blower.

FIG. 6 shows a cleaning station 100*d* that is employed instead of the cleaning station 100. A printing drum 10*d* turns in a counter-clockwise direction, see arrow 52*d*. A blower unit 260 is arranged under the shaft of the printing drum 10*d*. A discharge nozzle 262 is directed onto the surface of the printing drum 10*d* along the longitudinal direction of the printing drum 10*d*. The blower unit 216 generates a pressure p that is higher than the atmospheric pressure patm. This results in the air being blown through the discharge nozzle 262 into the depressions on the surface of the printing drum 10*d*. The air stream forces the printing fluid that has remained in the depressions out into a collecting basin 108*d*. The cleaning station 100*d* is surrounded by a housing (not shown) that prevents printing fluid from splattering out of the cleaning device 100*d*.

Figure 7:
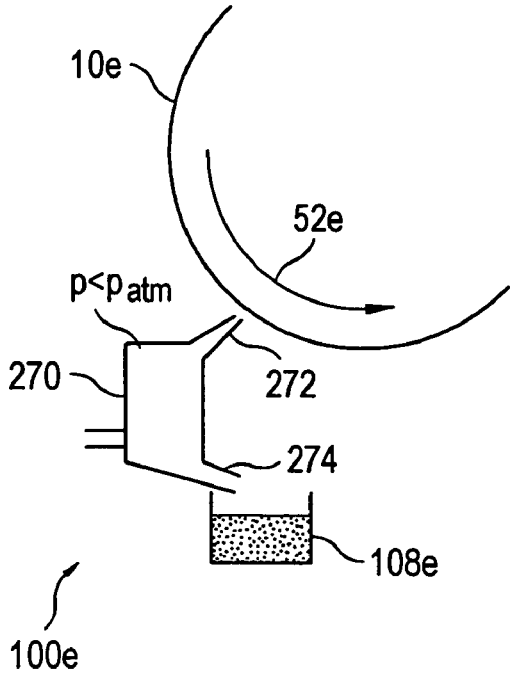
FIG. 7 is a cleaning station with a suction unit.

FIG. 7 shows a cleaning station 100*e* that is employed instead of the is cleaning station 100. A printing drum 10*e* rotates in a counter-clockwise direction, see arrow 52*e*. The cleaning station 100*e* contains a suction unit 270 that is arranged under the shaft of the printing drum 10*e*. An intake nozzle 272 of the suction unit 270 is directed such that an intake opening extends along the longitudinal direction of the printing drum 10*e* and lies at a short distance opposite the depressions moving past the cleaning station 100*e*.

A pressure p that is lower than the atmospheric pressure patm prevails in the suction unit 270. Air is thus sucked into the suction unit 270 through the intake nozzle 272. In common with the air, printing fluid that has remained In the depressions after being transported past the transfer printing location 92 is also suctioned off from the printing drum 10*e*. A drain channel 274 of the suction unit 270 discharges into a collecting basin 108*e*. The printing fluid that has been suctioned from the surface of the printing drum 10*e* proceeds from the inside of the suction unit 270 through the drain channel 274 and into the collecting basin 108*e*. A connection between collecting basin 108*e* and reservoir 62 is not shown in FIG. 7.

Although other modifications and changes may be suggested by those skilled in the art, it is the intention of the inventors to embody within the patent warranted hereon all changes and modifications as reasonably and properly come within the scope of their contribution to the art.

What is claimed is:

1. A method for printing a carrier material, comprising the steps of:

rotating a printing drum having a plurality of depressions for accepting printing fluid arranged on a surface of the printing drum around its longitudinal axis during a printing event;

introducing a predetermined quantity of a printing fluid by an inking station into depressions moving past the inking station;

employing the printing fluid from some of the depressions moving past a transfer printing location at said transfer printing station for printing the carrier material, and the printing fluid remaining in the rest of the depressions;

removing the printing fluid by a cleaning station from depressions by moving the depressions past the cleaning station;

removing any residual printing fluid remaining after cleaning by said cleaning station using ultrasound; and operating the cleaning station and the inking station simultaneously during the printing event.

2. A method according to claim 1, wherein the cleaning station includes a cleaning drum that lies parallel to the printing drum and whose surface touches the surface of the printing drum in a cleaning region during cleaning; and the surface of said cleaning drum is manufactured of an elastic or absorbent material.

3. A method according to claim 2, further comprising the step of:

providing an electrical potential on the cleaning drum that differs from a potential on the surface of the printing drum.

4. A method according to claim 2, wherein the cleaning station contains a stripper drum that lies parallel to the cleaning drum and whose surface exerts pressure onto the surface of the cleaning drum in a stripping region; and the surface of the stripper drum is fabricated of a hard material.

5. A method according to claim 1, wherein said step uf removing using ultrasound includes cleaning emptied depressions with a cleaning fluid activated with ultrasound energy from an ultrasound transmitter after the removal of the printing fluid from depressions moving past the cleaning station and before the introduction of printing fluid into depressions moving past the inking station.

6. A method according to claim 5, wherein said step of removing using ultrasound includes providing a container with said cleaning fluid activated with ultrasound energy; and further comprising the step of:

immersing the depressions moving past the container into the cleaning fluid activated with ultrasound energy so as to transmit the ultrasound energy through the cleaning fluid to clean said depressions of the printing fluid.

7. A method as claimed in claim 6, wherein said container with a cleaning fluid is arranged under the printing drum.

8. A method according to claim 5, further comprising the step of:

utilizing the printing fluid as the cleaning fluid.

9. A method according to claim 1, further comprising the step of:

directing a stream of air to displace printing fluid out of the depressions moving past the cleaning station.

10. A method as claimed in claim 9, wherein said cleaning station contains a blower unit to generate said stream of air.

11. A method according to claim 1, further comprising the step of:

drawing in a stream of air at the cleaning station to entrain printing fluid from the depressions moving past the cleaning station.

12. A method according to claim 1, further comprising the steps of:

collecting the printing fluid removed with by the cleaning station; and conducting the collected printing fluid to the inking station.

13. A method according to claim 12, further comprising the step of:

cleaning the printing fluid.

14. A method as claimed in claim 12, further comprising the step of rejuvenating the printing fluid.

15. A printer device for printing a carrier material, comprising:

a printing drum rotating around its longitudinal axis during the printing event and on whose surface a plurality of depressions for the acceptance of printing fluid are arranged;

an inking station for introducing a predetermined quantity of printing fluid into depressions that move past the inking station;

a transfer printing station at which printing fluid from some of the depressions moving past the transfer printing location is employed for printing the carrier material, and at which the printing fluid remains in the rest of the depressions moving past the transfer printing station;

a cleaning station for removing printing fluid from depressions that move past the cleaning station;

an ultrasound station including a cleaning fluid activated by ultrasound energy and applied to said printing drum; and a control unit for actuation of the cleaning station, the control unit simultaneously places the cleaning station and the inking station into operation during the printing event.

16. A printer device according to claim 15, wherein the cleaning station includes a cleaning drum that lies parallel to the printing drum and whose surface touches a surface of the printing drum in a cleaning region; and further comprising:

a connection for applying an electrical potential to surface of the cleaning drum which differs from a potential at the surface of the printing drum.

17. A printer device for printing a carrier material, comprising:

a printing drum rotating around its longitudinal axis during the printing event and on whose surface a plurality of depressions for the acceptance of printing fluid are arranged;

an inking station for introducing printing fluid into depressions that move past the inking station;

a transfer printing station at which printing fluid from some of the depressions moving past the transfer printing location is employed for printing the carrier material, and at which the printing fluid remains in the rest of the depressions moving past the transfer printing station;

a cleaning station for removing printing fluid from depressions that move past the cleaning station;

a control unit for actuation of the cleaning station, the control unit simultaneously places the cleaning station and the inking station into operation during the printing event;

wherein the cleaning station includes a cleaning drum that lies parallel to the printing drum and whose surface touches a surface of the printing drum in a cleaning region;

a connection for applying an electrical potential to surface of the cleaning drum which differs from a potential at the surface of the printing drum;

wherein the cleaning station includes a stripper drum that lies parallel to the cleaning drum and whose surface presses onto the surface of the cleaning drum in a stripping region.

18. A printer device according to claims 15, wherein the cleaning station includes a blower unit with whose assistance air is blown into the depressions moving past the cleaning station.

19. A printer device as claimed in claim 15, wherein the cleaning station includes a suction unit with whose assistance air is sucked out of the depressions moving past the cleaning station.

* * * * *